United States Patent [19]

Pasic et al.

[11] 4,058,426

[45] Nov. 15, 1977

[54] METHOD AND APPARATUS FOR WRAPPING OBJECTS WITH A SEALABLE WRAP

[75] Inventors: James A. Pasic; Marvin I. Berg, both of Montesano, Wash.

[73] Assignee: Ovalstrapping, Inc., Hoquiam, Wash.

[21] Appl. No.: 694,081

[22] Filed: June 9, 1976

[51] Int. Cl.[2] ..... B31F 31/00

[52] U.S. Cl. ..... 156/212; 53/39; 53/198 R; 156/468; 156/522; 156/583

[58] Field of Search ..... 106/468, 583, 213, 212, 106/486–492, 522; 53/198 R, 39

[56] References Cited

U.S. PATENT DOCUMENTS

| | | | |
|---|---|---|---|
| 3,263,390 | 8/1966 | Dexter | 53/198 R X |
| 3,551,260 | 12/1970 | Catherwood | 53/39 |
| 3,551,261 | 12/1970 | Histed | 156/583 |
| 3,621,633 | 11/1971 | Law | 53/198 R |

*Primary Examiner*—David A. Simmons

*Attorney, Agent, or Firm*—Seed, Berry, Vernon & Baynham

[57] ABSTRACT

A parallelogram linkage controls the speed of a sealing and cutting bar while in engagement with a polyethylene wrap while the wrap is being sealed around an object moving along a conveyor. The linkage assures synchronism between the speeds of the sealing and cutting bar and a resilient roller between which the wrap is pressed during sealing and cutting. Pressure on the sealing and cutting bar is controlled by an adjustable but controllable air pressure link. Sealable wrap is uniquely stored on the top and bottom sides of the conveyor such that it may be freely released when the object engages a web formed by the initial sealing of the two wraps together at a wrapping station. Once the wraps have been cut and sealed to form a new web at the rear of the previously wrapped object, the web is drawn back to position it for engagement by the next object in the path. Also disclosed is the method of accumulating lightweight polyethylene-type films so that they may be easily pulled from the storage position for wrapping around an object moving along a path.

16 Claims, 10 Drawing Figures

FIG. 3
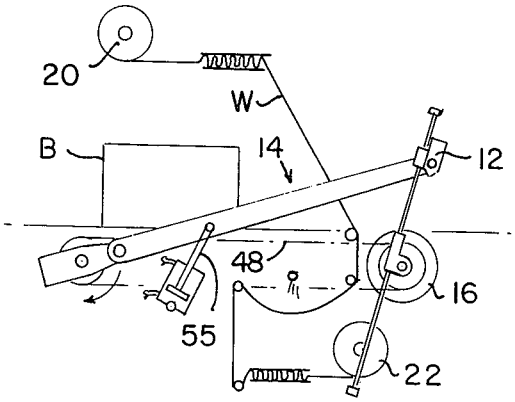
FIG. 4
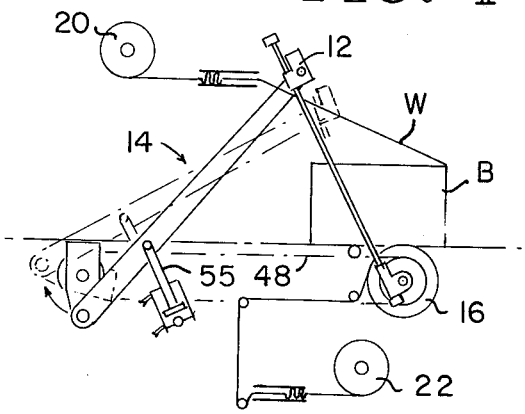
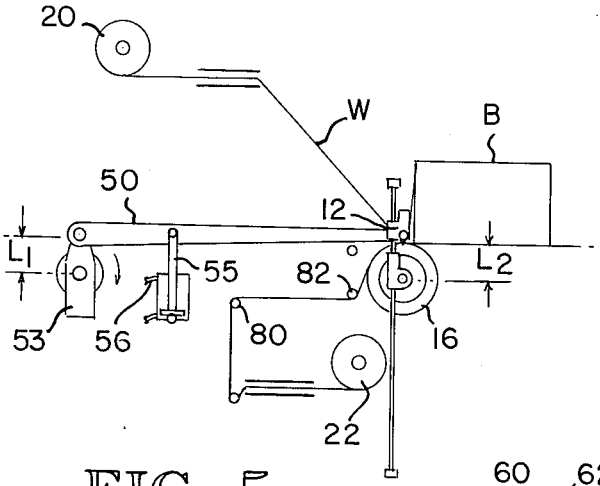
FIG. 5
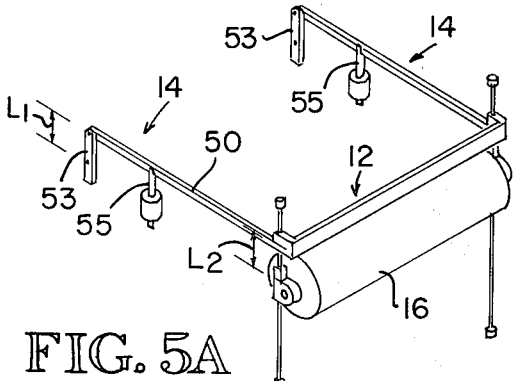
FIG. 5A
FIG. 8
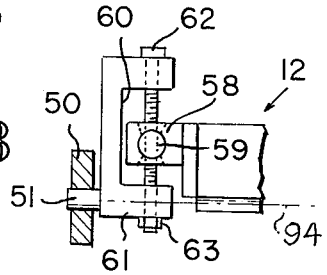
FIG. 6
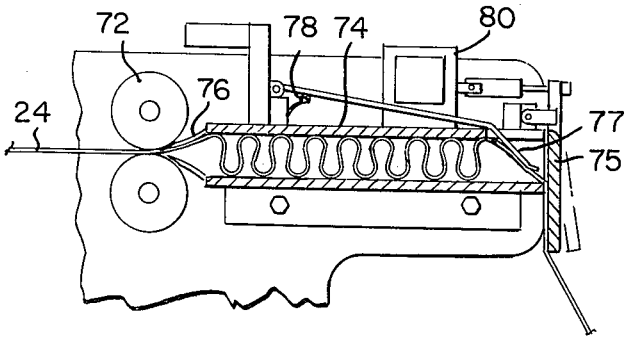
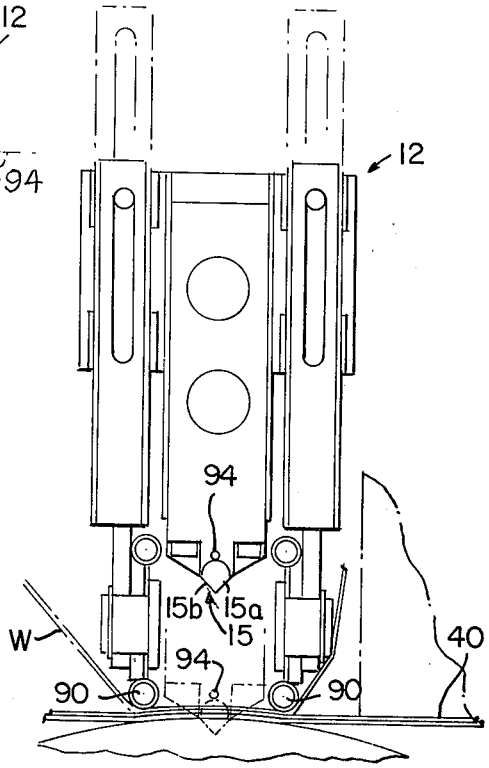
FIG. 7

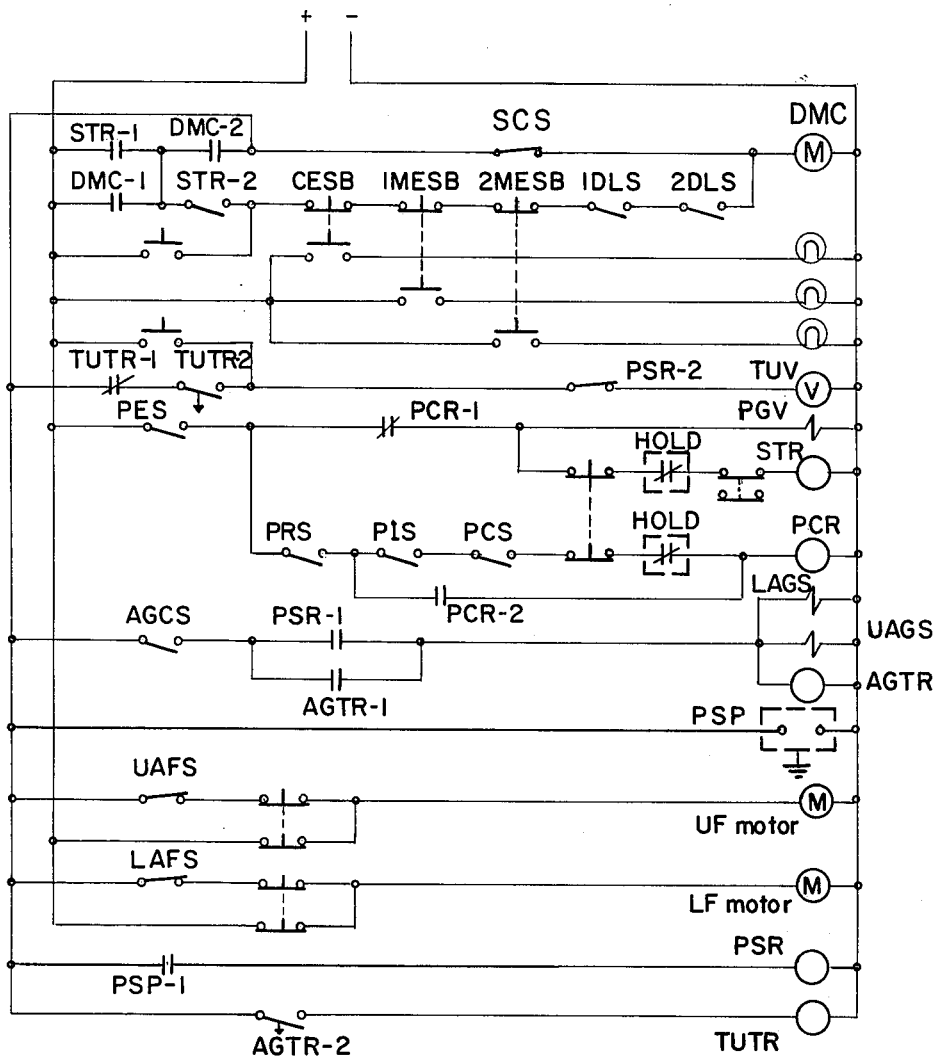
FIG. 9
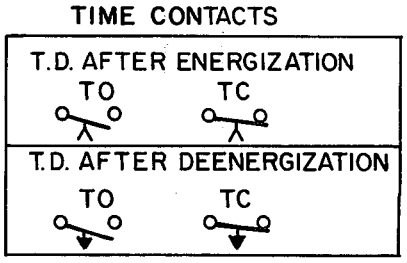

METHOD AND APPARATUS FOR WRAPPING OBJECTS WITH A SEALABLE WRAP

BACKGROUND OF THE INVENTION

1. Field of the Invention

This invention pertains to methods and apparatus for wrapping a film of wrapping material around an object at a wrapping station and, more particularly, to improved apparatus for controlling the relative position of a cutting and sealing bar on the film during the cutting and sealing operation. In addition, the invention pertains to a method and apparatus for controlling the feed of lightweight films of wrapping material which are sealed together in the form of a web and drawn about an object to be wrapped.

2. Description of the Prior Art

Various types of devices have been used heretofore to wrap an object with a heat-sealable film or wrapping material. Generally, these devices supply wrapping material from two vertically spaced rolls sealing them together at a wrapping station to form a web. An object is then conveyed through the wrapping station where it engages the web pulling additional wrapping material from the supply rolls and a heat-sealing and cutting unit travels down behind the object to seal and cut the wrap encircling the object. The sealing and cutting unit separates the wrap on the object from the wrap on the supply rolls and simultaneously forms a new web at the wrapping station. Typical of these devices is the one shown in U.S. Pat. No. 3,551,260 granted to Catherwood. One difficulty in providing a good seal on the wrap around the object or on the new web is to avoid relative movement during the sealing and cutting operation between the sealing and cutting unit and a resilient roll against which the unit presses the wrap during cutting and sealing. As can be seen in the Catherwood patent, attempts to reach the same relative velocities have been met with complicated mechanism which, while attempting to generally reach identical speeds, have not, in fact, achieved such identical velocities and as a result, have not achieved satisfactory sealing of the wrap.

Still another problem with the sealing and cutting apparatus of the prior art has been the difficulty to accommodate irregularities in the periphery of the resilient sealing roll to obtain uniformity of sealing and cutting pressure transversely across the entire length of the wrap. In the prior art, irregularities in the peripheral surface of the roll has resulted in variations in the pressure between the cutting and sealing unit and the resilient roll resulting in inadequate sealing pressure applied at some parts of the wrap and excessive pressure at others, thus resulting frequently in an unsatisfactory seal.

Still another problem in prior art sealing and cutting apparatus is that production rates and sizes of objects being handled in prior art apparatus have been limited. For example, in the Catherwood U.S. Pat. No. 3,551,260, the sealing and cutter unit follows an elliptical path to increase the height of the objects being handled but this elliptical path uses too great a time to complete to reach high desirable production rates such as 60 objects per minute.

Still an additional problem in prior art wrapping methods and apparatuses is caused by the difficulty in handling polyethylene or other lightweight heat-sealable wrap or films and to allow them to move freely out of the supply while the object is being wrapped.

SUMMARY OF THE INVENTION

It is a first object of this invention to provide an improved apparatus for controlling the relative speed between the cutting and sealing unit and the resilient roll between which the sealable wrap is pressed during sealing and cutting.

Basically, this object is obtained by providing a parallelogram linkage with the two rotational links forming opposite ends of the parallelogram having exactly the same radii during the sealing and cutting operation, thus assuring that the angular velocity between the sealing and cutting bar and the resilient roll is identical. In this way, there is no relative movement between the sealing and cutting unit and the resilient roll regardless of the speed with which the apparatus is being driven. That is, since the angular velocity of the two links of the parallelogram are identical and since their radii are also identical, then there is no relative tangential movement between the sealing and cutting bar and the resilient roll during the period that the sealing and cutting bar is in engagement with the resilient roll.

It is another object of this invention to provide linkage for pressing a sealing and cutting bar against a heat-sealable film on a resilient roll in such a manner as to maintain the pressure between the sealing and cutting bar and the roll substantially uniform throughout the length of the cutting bar and roll.

Basically, this object is obtained by providing a linkage for moving both ends of the sealing and cutting bar into engagement with the film while on the resilient roll and providing a constant but adjustable pressure on both ends of the sealing and cutting bar regardless of the angular inclination of the bar relative to the rotational axis of the resilient roll. In the preferred embodiment, this constant pressure is obtained by interposing an extendable cylinder and piston in the parallelogram linkage aforedescribed with air pressure being applied on the piston in a direction to provide a constant force on the sealing and cutting bar toward the resilient roll.

Still another object of this invention is to provide a method and apparatus for delivering lightweight film or wrap to a wrapping station so that it can be engaged by an object at the wrapping station and pulled around the object without causing substantial resistance to movement of the object.

Basically this object is obtained by providing accumulators at each of the film or wrap supplies which accumulators store the wrap in a series of accordian folds and at a proper sequence, when it is desired to release the stored folds, a gate at the forward end of the accumulator is opened allowing the film or wrap to move freely out of the accumulators without substantial resistance.

The preferred apparatus for carrying out this object is to provide storage bins into which the film or wrap is pushed by a pair of pinch rolls accumulating the wrap in a series of vertical folds, when the bin is full to halt delivery of additional film, and to then open the opposite end of the bin and allow the film to be drawn out freely, unfolding as it is pulled out by the moving object.

Still another object of this invention is to provide a method and apparatus for drawing back the newly formed web of wrap so that it is upstream from the wrapping station and out of the path of the sealing and cutting bar when cycled without an object passing through the wrapping station.

This object is best obtained by moving a length of the wrap laterally out of its path to tighten the web, thus moving it rearwardly from the location at which it was sealed at the rear of an object at the wrapping station into an upstream location ready for the next object. In the preferred embodiment, the wrap is moved by an adjustable air pulse.

Using the apparatus and methods of this invention, packages can be wrapped with a sealable wrap, particularly heat-sealable film, at a high rate of speed and with a superior bond formed at the forward and rearward ends of the package. With a rearwardly skewed straight-down path of the sealing and cutting bar, objects of large height can be handled very quickly because the cutter bar is raised quickly from in front of the object and returned quickly against the rear of the object. With the unique accumulating technique for the lightweight film or wrap, a package can draw film around it without slowing down in the conveyor and getting out of synchronism with other objects on the conveyor. Furthermore, the free discharge of the film material assures a very low tensioning in the film so that the seal, at the front of the object, is not overly stressed until after it has had sufficient time to cure. The parallelogram linkage and synchronism between the rotational speeds of the identical radii of the links forming the parallelogram assure identical movement between the sealing and cutting bar and resilient roller, thus assuring a good seal.

BRIEF DESCRIPTION OF THE FIGURES OF THE DRAWING

FIGS. 3–5 are schematic side elevations illustrating the formation of a wrap about an object. FIG. 3 illustrates an object entering a wrapping station with a sealing bar on an upward path and wrap accumulated ready to be released. FIG. 4 illustrates an intermediate step in the operation with the sealing and cutting bar beginning to travel downwardly toward the rear of the object being wrapped. FIG. 5 illustrates the unique parallelogram formed between the links controlling movement of the sealing and cutting bar and the distance between the sealing and cutting bar and the axis of rotation of the resilient roller to assure the identical tangential velocities are achieved between the sealing and cutting roller and the peripheral surface of the resilient roller.

FIG. 5*a* is a further schematic illustration showing an isometric of the parallelogram linkage embodying the principles of the invention.

FIG. 6 is a fragmentary vertical section taken along one of the film wrap accumulators embodying the principles of the invention.

FIG. 7 is a section transversed to the sealing and cutting bar.

FIG. 8 is a fragmentary schematic side elevation illustrating a portion of the sealing and cutting apparatus.

DETAILED DESCRIPTION OF THE PREFERRED EMBODIMENTS

Figure 1:
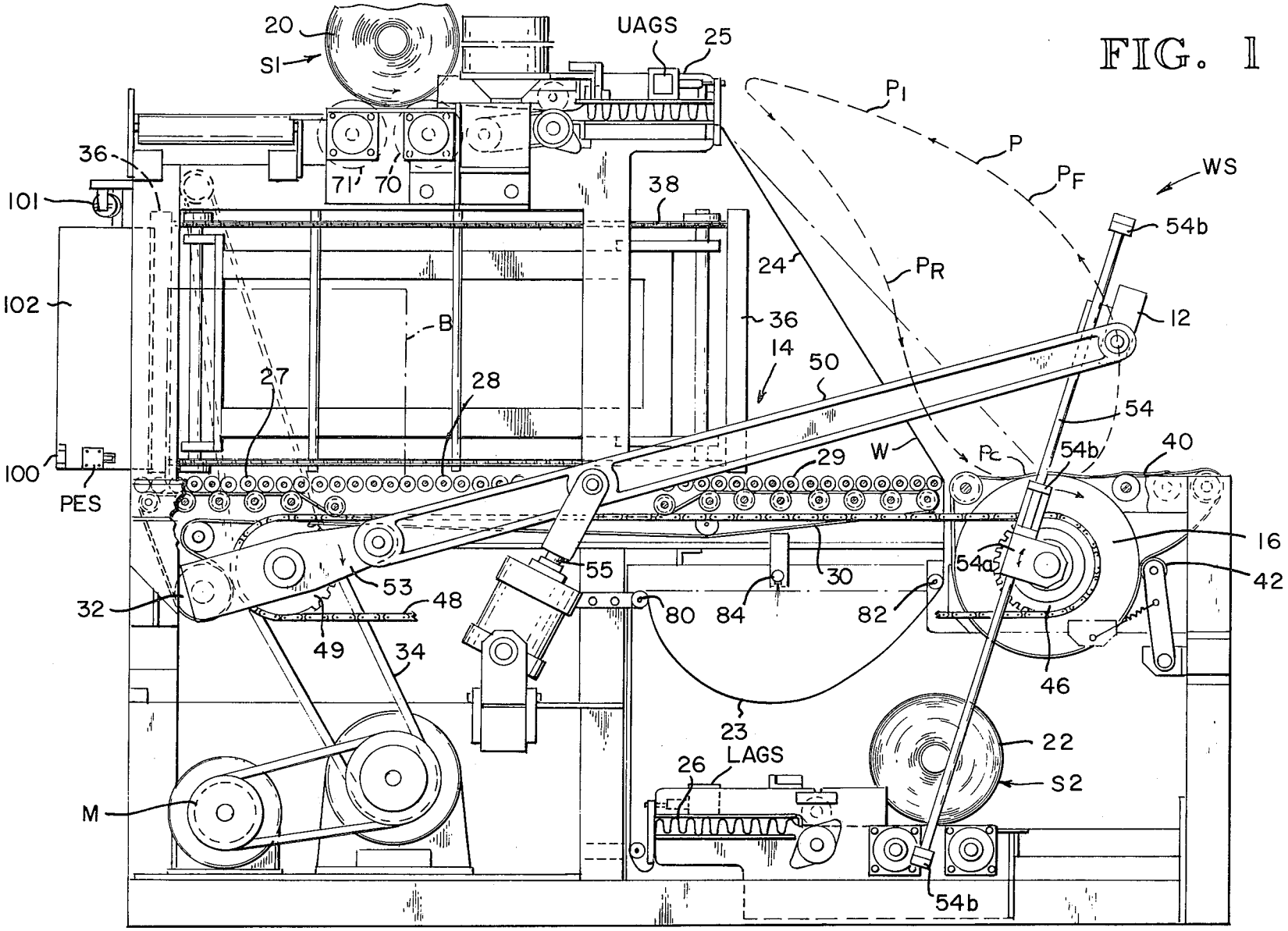
FIG. 1 is a fragmentary side elevation of a wrapping apparatus showing sealing and cutting apparatus embodying the principles of the invention.

As best illustrated in FIG. 1 is a wrapping machine of the type suitable for wrapping and sealing films or wrap such as polyethylene or polypropylene around an object. The films are sealed together by heat and pressure to form a web which is wrapped around the object providing a relatively water-impermeable wrapping tightly around the package. One application for such wraps is around bundles of newspaper or other stacked articles. While some aspects of the invention, such as the accumulation and delivery of lightweight films, such as polypropylene or polyurethane films, is of primary importance to the handling of such films, other aspects of the invention, such as the synchronization between the sealing and cutting unit and the resilient roll, are applicable to the sealing and cutting of other wraps not necessarily requiring the application of heat. That is, the principles of invention have applications for bonding techniques other than heat sealing.

The wrapping apparatus is provided with a sealing and cutting mechanism having a sealing and cutting bar 12 which forms part of a linkage 14. The linkage 14 moves the bar through a rearwardly skewed, kidney-shaped path P. The sealing and cutting bar 12 is provided with a heated and sharpened edge 15 (FIG. 7) having forward and rearward flanks 15*a* and 15*b*. These flanks move with the edge as it presses into the resilient surface of a resilient roll 16 causing a web W of wrap to be severed while the web is sealed immediately forward and rearwardly of the edge 15.

The web W is formed from upper and lower supplies S1 and S2 of film carried in rolls 20 and 22, respectively. The film is designated as a lower length of film 23 and an upper length of film 24 which are fused together to form the web W. The film is stored in accumulators 25 and 26 of substantially identical construction.

Objects such as a bundle B are moved through the wrapping apparatus on a conveyor formed of a plurality of live rolls 27, free spinning rolls 28 and another set of live rolls 29. The live rolls are driven by a belt 30 powered by a drive roller 32. The drive roller is powered by a motor M through chains and sprocket drives 34. The bundle is moved by the live rollers onto the freely spinning rollers 28 where it is held until engaged by a pair of retractable vertical paddles 36. These paddles are driven by opposite chains and sprockets 38 in synchronism with movement of the sealing and cutting bar 12 so that the bundle is delivered to the forward live rollers 29 at the exact synchronized desired time relative to the sealing and cutting bar. The paddles 36 and conveyor 38 are conventional with the paddles being retracted in a well known manner as they return to pick up the next bundle and are extended as they move along an inner path into engagement with the bundle. At the wrapping station WS a loose fiberglass Teflon-coated belt 40 moves the package through the wrapping station. The looseness allows the cutting edge to press into the resilient roll and the Teflon coating assures that the film will not adhere to the belt surface during sealing and cutting. A drive roller 42 pushes the belt against the resilient roll 16 to cause the belt 40 to be driven.

An important aspect of the invention is the interrelationship between the links of the opposite linkages 14 and their angular velocities. As best shown in FIG. 1, the resilient roller 16 is driven by a sprocket 46 through a chain 48, and a sprocket 49. The sprockets 49 and 46 are of the same diameter providing them with identical angular velocities. Each linkage 14 includes an elongated first link 50 that is pivotally mounted adjacent one end as by a pivot 51 (FIG. 8) to the sealing and cutting bar 12. Adjacent its opposite end the elongated first link 50 is rotatably coupled to a second link 53 which rotates with the sprocket 49. As is best shown in FIGS. 1 and 5, the radius L1 of the link 53 between its center of rotation and its pivotal connection to the elongated link 50, is exactly equal to the distance L2 from the center of the resilient roll 16 to the pivot 51 at the time the sealing bar is in engagement with the resilient roll. Consequently, since the distances L1 and L2 and the rotational speeds are identical, the sealing and cutting bar at its point of engagement with the roller must travel at exactly the same tangential or peripheral velocity as the resilient roll surface, thus assuring that no slippage occurs between the sealing and cutting surfaces 15, 15*a* and 15*b* and the film W.

Movement of the unit 12 toward the roll 16 is also controlled by guide rods 54 which slide both in sleeves 54*a* which are mounted for pivoting movement on the axis of roll 16 and within the unit 12. Stops 54*b* limit the movement of the guide rod. The primary function of the guide rods is to assure the cutting edge 15 moves into the roll 16 along a diameter of the roll to insure that the unit 12 is normal to the center of the roll.

In order to provide a downward pressure between the sealing and cutting bar 12 and the resilient roll 16 and to enable the linkage to adjust to provide the proper distance L2, an extendable link 55 having a piston rod and cylinder is pivotally connected to the elongated link 50 and to the frame. Air is introduced above the piston as at 56 at a constant but adjustable pressure to provide an equal and constant downward pressure on the elongated links of both linkages 14. This constant pressure is desirable to provide a constant pressure along the length of the cutting edge 15 across the entire length of the roller 16. To further assure this uniform pressure, each end of the sealing and cutting bar is provided with an aperture 58 (FIG. 8) in which is centered a pivot pin 59. The pivot pin is positioned in a recess 60 of a pivot bracket 61 which is secured to the pivot 51. A bolt 62 is threadably received in the pivot pin 59 and by rotation of the bolt can move the pivot pin vertically within the recess 60 to accurately position the end of the sealing and cutting bar relative to the surface of the resilient roller 16. A nut 63 locks the adjustment bolt 62 after the position is obtained. Thus, each end of the sealing and cutting bar can be accurately positioned to be perfectly parallel to the surface of the resilient roll. Since each end of the sealing and cutting bar, however, can pivot independently, any irregularity in the peripheral surface of the resilient roll or any irregularity in the thickness of the film will cause the sealing bar to pivot but since the pressure pulling down against the roll is maintained constant by the air within the cylinder links 55, the pressure between the sealing bar and the resilient roll will be maintained substantially uniformly constant along the length of the roll. Furthermore, the adjustment bolts 62 also allow for repositioning the pivots 51 to make L2 equal L1 when the pressure is increased or decreased in the cylinders of the extendable links 53 and resulting in a different penetration depth into the resilient roll.

The linkage described is such that it causes the sealing and cutting bar 12 to move in the path P best illustrated in FIG. 1. This path has a forward portion PF which follows a very sharp upward arcuate motion which lifts it quickly from in front of the object being wrapped. This forward portion is followed by an intermediate portion PI of more gradual arcuate shape. The curvature PF plus PI, however, is also skewed rearwardly so that while the sealing and cutting bar is raised relatively quickly, it is also simultaneously being moved rearwardly. At the end of the portion PI, the path takes a very sharp substantially straight path PR which causes it to be moved downwardly quickly and forwardly in the same direction as the object traveling in front of it. Since the unit travels in the same direction as the object during the PR downstroke it travels a minimum distance to reach the roller 16 thus allowing an increase in the number of objects and velocity of the objects. The combined path P provides an optimum movement of the sealing and cutting bar up out of the way from the next oncoming object B and then quickly down rearwardly behind the object to seal and cut the web immediately behind the object. The path allows increases in production speeds over prior art devices. The extendable links 53 allow the sealing and cutting unit to deviate from the path to form the curved portion Pc as the unit follows generally the outer peripheral shape of the roll 16.

Figure 2:
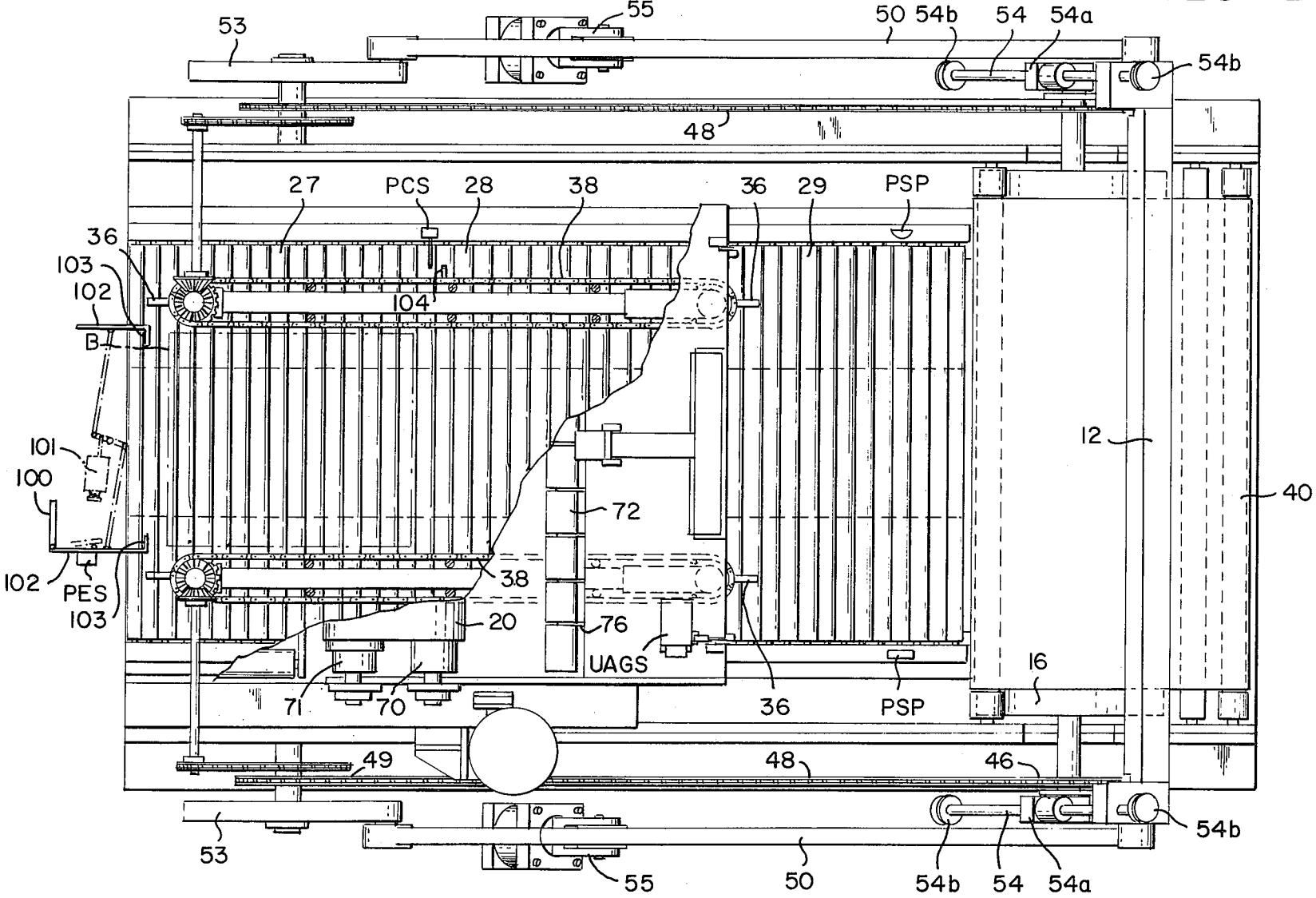
FIG. 2 is a plan view of the apparatus shown in FIG. 1.

The unique film accumulating aspect of this invention is best shown in FIGS. 1, 3 and 6. The accumulating devices are substantially identical, therefore only the upper accumulating device will be described. The roll of film 20 rides on an idler roller 70 and a driven roller 71. The driven roller 71 rotates the roll in the direction illustrated toward a pair of driven pinch rollers 72. The pinch rollers are driven at a slightly faster speed than the drive rollers 71 to provide a slight tension on the film. The pinch rollers also push the film into a storage bin 74 having a pivotally-mounted closing gate 75 at its forward end. At the rearward end the rollers are segmented as best shown in FIG. 2 and are provided with sets of spring strips 76 that diverge outwardly toward the storage bin. These strips are spaced from one another between the segments of the rollers 72 to prevent the film from moving up around the rollers and thus guide the film into the bin 74. The film forms abutting accordian folds as illustrated in exaggerated form in FIG. 6 accumulating within the bin until sufficient folds are in place to raise a sensing paddle 77. The paddle is connected to a switch 78 which stops the rollers 71 and 72 when the bin has received a full supply of folds. The gate 75 is moved between its closed solid line position in FIG. 6 and an open position shown in phantom lines, by a solenoid 80. This opening occurs at the time the bundle engages the web W and allows the film to freely move without resistance outwardly of the bin 78. This free movement assures that light bundles or objects B will not slide on the conveyor belt 40. Secondly, the sealing and cutting bar 12 is moving rapidly as it first engages the web from behind the object (FIG. 4) and since the film is free to move easily, the package is not slowed in its path or pulled back by the sealing bar as it begins to draw additional film outwardly. Thirdly, since the seal previously made and now at the front of the bundle in most cases has not yet cured the free movement of the film out of the bins assures that an undue strain will not be placed on this seal.

While both of the supplies S1 and S2 operate in substantially identical fashion, an important feature is added to one of the supplies, preferably supply S2. It is necessary to pull the web rearwardly from its point of engagement with the resilient roller after each sealing and cutting operation. This assures that the sealing and cutting bar, when making another cycle, will not get tangled in the web should an object not be present to be wrapped. The wrap length 23 traverses a run between a pair of rollers 80 and 82 (FIGS. 1 and 5) and which at the time of sealing the length has little slack. After the seal is made and the sealing and cutting bar has started its upward path, this run is subjected to a pulse of air from a plurality of nozzles 84 spaced transversely along the underside of the wrapping apparatus. The air pulses move the length downwardly as shown in FIGS. 1 and 3 to draw the film back into the solid line position shown in FIGS. 1 and 3. As can be seen, this is clear of the path of the sealing and cutting bar but places the film in a loose position to be ready to be drawn tight again as the next object pulls additional film from the supply rolls.

The sealing and cutting bar 12 is provided with a pair of guiding and clamping bars 90 which are spring-biased downwardly. These bars hold the web W firmly against the conveyor surface 40 as the sealing and cutting surfaces 15, 15*a* and 15*b* are pressing the web into the resilient surface of the roller 16. The actual pivot axis of the sealing and cutting bar 15 when it is engaged with the resilient roller 16, is about an axis 94 (FIG. 7) through the center of pivot 51 The exact location of this pivot point is adjusted by screw 62 to provide the correct length of L2 to maintain the exact velocity relationship between the linkage length L1 and L2.

The operation of the apparatus can best be described in relation to the accompanying electrical schematic of FIG. 9. Only the functional elements of the circuit will be described for brevity it being understood that the full operation of the circuit is readily understood by one skilled in the art.

A bundle or package approaching the wrapping apparatus actuates a pacer entering switch PES by engaging a sensor arm 100. A pacer gate valve PGV energizes, pressurizing a cylinder 101 and causes a gate 102 to close and stop the package. The package will continue to move until it is against the stops 103 at the end of the gate. Arrival of the package in this position will actuate a pacer ready switch PRS. Closing of the gate actuates a pacer in switch PIS thus enabling the circuit to a pusher clear time relay PCR. Actuation of switch PES also energizes a stop time relay STR. The STR contacts STR-1 and STR-2, contacts close and providing stop buttons (CESB, 1MESB, 2MESB) and door interlock switches (1DLS, 2DLS), are closed drive motor contactor DMC will energize and start the motor M. The pusher chain 38 has a dog 104 that will actuate pusher clear switch PCS when the paddles 36 are in the position to receive the package. This energizes the pusher clear relay PCR. PCR-1 contacts open de-energizing PGV. The gate opens and releases the package. The package enters the wrapping apparatus and is picked up by the pusher paddles 36 and pushed up to, and started through the web W of film. As the package nears the film it actuates a package sealing photo light PSP. PSP-1 contacts close and energize package sensing relay PSR. The PSR-1 contacts close and enable the circuit to accumulator gate solenoids LAGS and UAGS and to the accumulator gate time relay AGTR.

A cam (not shown) on the main crank shaft will actuate an accumulator gate control switch AGCS just as the package contacts the film curtain. This energizes LAGS, UAGS and AGTR. Energization of AGTR closes the AGTR-2 contacts causing the take up time relay TUTR to energize. AGTR-2 contacts have an automatic time delay before opening. Contacts TUTR-1 open and the contacts TUTR-2 (time delay contacts) close thus enabling the circuit to the take up valve TUV. Energization of LAGS and UAGS will open both the upper and lower accumulator doors and allow the film to be drawn out of the accumulators as the package proceeds down the conveyor. The sealing bar 12 comes down behind the package and presses the two sheets of film together and against the sealing roll. This cuts the film and seals the sheet together before and after the cut. The result is a sealed package leaving the machine and the top and bottom film sheets rejoined to form the web for the next package. When the sealing bar lifts from the sealing roll the contacts AGCS will open and de-energize LAGS, UAGS and AGTR. The accumulator doors 75 close preventing additional film from being drawn from the accumulators. The contacts AGTR contacts open after a time delay that is sufficient to allow the curtain seal to harden. This then deenergizes TUTR. Contacts TUTR-1 close and energize valve solenoid TUV. This causes air to blow on the lower sheet through nozzles 84 to draw the film back to the initial start position. The contacts TUTR-2 open after a delay and deenergize TUV to stop the air blow. STR-2 contacts time open to stop the machine providing a new package has not arrived for wrapping. If at any time the supply of film in the upper or lower accumulators becomes exhausted the actuator on the empty accumulator will drop to the down position and cause the mercury switches UAFS or LAFS to close and energize the respective film feed motor. The respective motor will run until the film lifts the paddle 77 to the off position. The stop control switch SCS is actuated by a cam (not shown) on the main crank at the time when the sealing bar is against the rubber roll 16. This prevents the machine from stopping with the hot bar in contact with the roll. Contacts PSP-1 contacts prevent the blow back from taking place if there is a second package immediately following the first, in this case the second package will be drawing film from the accumulator at the time when the blow for the first package would be taking place.

The embodiments of the invention in which a particular property or privilege is claimed are defined as follows:

1. Sealing and cutting apparatus for securing wrap around objects to be wrapped traveling successively on a conveyor with resilient roll means being provided in the path of the conveyor against which the sealing and cutting apparatus can press the wrap, comprising:

a sealing and cutting unit having means for sealing two pieces of the wrap together and means for cutting the wrap by pressing the wrap against said resilient roll means, linkage means for guiding said sealing and cutting unit into engagement with wrap passing over said resilient roll means at a time when sealing and cutting is desired, means for driving said linkage means for moving said linkage means, said linkage means forming a parallelogram with said driving means and said resilient roll means with the sealing and cutting unit moving with the resilient roll means at the same angular and peripheral velocity at said sealing and cutting time whereby slippage of the sealing and cutting unit along the wrap is minimized, and said linkage means including biasing means for pressing the sealing and cutting unit toward said resilient roll means for pressing the wrap therebetween.

2. The sealing and cutting apparatus of claim 1, said linkage means including a first link having opposite first and second ends, said first end pivotally mounting said sealing and cutting unit, a drive link coupled to said drive means and pivotally mounted to said second end of said first link, a slidable guide link pivotally mounted for movement concentric to rotation of said resilient roll means so that the sealing and cutting unit are guided to move normal to the peripheral surface of the resilient roll means, the distance between the pivot connections of said drive link being equal to the distance between the axes of rotation of said resilient roll means and the sealing and cutting unit during the period the sealing and cutting unit is pressing the wrap against the resilient roll to effect said same velocities.

3. The sealing and cutting apparatus of claim 1, said biasing means including an extendable piston rod pivotally connected to said first link between its opposite first and second ends with adjustable air pressure on its piston urging the piston rod to move the first link toward the resilient roll, said linkage means including an additional set of parallelogram links and biasing means spaced transversely on the opposite side of said conveyor, said pivotal mounting of said sealing and cutting unit including first aligned pivots on opposite ends of said sealing and cutting unit coupled to the first ends of said first links for pivotal movement about a common axis transverse to said conveyor, and second pivots between said sealing and cutting unit and said first ends of said first links for pivotal movement about axes longitudinal of said conveyor whereby one transverse end of said sealing and cutting unit can pivot to a different elevation than the opposite end of said sealing and cutting unit with said biasing means maintaining equal pressure on each end of said sealing and cutting unit to maintain a uniform sealing pressure across the binding material.

4. The sealing and cutting apparatus of claim 3, said first and second pivots between said sealing and cutting unit and said first ends of said first links each including a pivot block with a central recess, said first pivot pivotally coupling said first link with said pivot block, an adjustment bolt passing vertically through said recess, said second pivot being threadably secured to said bolt for adjusting the vertical location of the ends of the sealing and cutting unit relative to said resilient roll.

5. The sealing and cutting apparatus of claim 1, said linkage means providing a path of movement of said sealing and cutting unit having a generally rearwardly and upwardly arcuate direction, followed by a forwardly and downwardly generally straight direction, followed by a forwardly generally horizontal direction which conforms generally to the periphery of the resilient roll during contact therewith, with the overall general shape of the path of the sealing and cutting unit resembling a rearwardly skewed kidney shape whereby the path of movement quickly removes the sealing and cutting unit from behind the object to clear the next oncoming object, raises the unit to clear high objects, and quickly returns the unit behind the next oncoming object to make another seal.

6. Object wrapping apparatus for placing a continuous wrap around an object with the wrap being fed from two supplies and joined in front and behind the object comprising:

a conveyor for carrying an object past a wrapping station, an upper wrap supply, a lower wrap supply, each wrap supply having a roll of sealable wrap, and a wrap accumulator, means for engaging the two wraps to seal the wraps together on the conveyor, to form a web in the path of the oncoming object and close to the rear of the previously passed object, said accumulators each including a storage bin having infeed and discharge ends and including means for gathering the wrap in folds and holding the folds at the discharge ends of each bin until released, and means for releasing the wrap at the discharge ends at a predetermined time to allow the wrap to be pulled freely without restriction between the discharge ends and the conveyor by the object and the sealing means.

7. The apparatus of claim 6, said wrap folds gathering and holding means including feeding means for pushing the wrap into folds in the accumulator, and sensor means for determining when the bin is full for discontinuing said feeding means.

8. Object wrapping apparatus for placing a continuous wrap around an object with the wrap being fed from two supplies and joined in front and behind the object comprising:

a conveyor for carrying an object past a wrapping station, an upper wrap supply, a lower wrap supply, each wrap supply having a roll of sealable wrap, and a wrap accumulator, means for engaging the two wraps to seal the wraps together on the conveyor, to form a web in the path of the oncoming object and close to the rear of the previously passed object, said accumulators including means for gathering the wrap in folds and holding the folds until released, and means for releasing the folds at a predetermined time to allow the object and the sealing means to freely pull the web out of the accumulators, said accumulators each including a storage bin having infeed and discharge ends, said wrap folds gathering and holding means including feeding means for pushing the wrap into folds in the accumulator, and sensor means for determining when the bin is full for discontinuing said feeding means, said releasing means including a gate movable into an opened position at the discharge end of the bin to allow the wrap folds to freely be pulled out of the storage bin.

9. The apparatus of claim 8, each said wrap supply having a roll of wrap, said feeding means including a driving roll engageable with said wrap roll, a set of driven pinch rolls for pulling wrap from the wrap roll, applying tension on the wrap between the driving roll and the pinch rolls and pushing the wrap into the bin, and a plurality of guide strips diverging from said pinch rolls into said bin whereby the wrap moves forward into the bin and builds up in folds between said gate and the infeed end of the bin.

10. The apparatus of claim 6, said web lying downstream along said wrapping station after a web is formed around an object, said accumulator further including means for pulling said web rearwardly and for tightening the web at said wrapping station.

11. The apparatus of claim 9, said web lying downstream along said wrapping station after a web is formed around an object, said accumulator further including means for pulling said web rearwardly and for tightening the web at said wrapping station, said web pulling and tightening means including a set of spaced guide rollers guiding said wrap along a run from a wrap supply to said wrapping station, and air jet means for blowing the wrap out of said run to withdraw a portion of the wrap from said wrapping station thus pulling and tightening the web at the wrapping station.

12. The method of delivering two sealable lengths of wrap to a wrapping station to form a web and be wrapped around an object moving along a horizontal path, comprising:

storing the wraps at a storage station on opposite sides of the path, holding the wraps against movement at the storage station, joining the wraps at a sealing and cutting location, moving the object into engagement with the web to pull the web along the path, releasing the held, stored wrap at the storage station and providing a free unrestricted path between the storage station and the object as the object pulls the web to eliminate resistance to movement of the web as the object pulls the web, cutting the web behind the object and sealing the wraps to form a new web behind the object at a cutting and sealing station, and tightening and retracting the new web across the path rearwardly from the sealing and cutting station.

13. The method of claim 12, said step of storing the wraps including folding the wraps in accordian fashion.

14. The method of delivering two sealable lengths of wrap to a wrapping station to form a web and be wrapped around an object moving along a horizontal path, comprising:

storing the wraps on opposite sides of the path, joining the wraps at a sealing and cutting location, moving the object into engagement with the web to pull the web along the path, releasing the stored wrap as the object pulls the web, cutting the web behind the object and sealing the wraps to form a new web behind the object at a cutting and sealing station, and tightening and retracting the new web across the path rearwardly from the sealing and cutting station, said step of storing the wraps including folding the wraps in accordian fashion, said lengths of wrap each being movable along a separate run intersecting at said cutting and sealing station, said step of tightening the new web including blowing the wrap out of a run to pull the wrap back from said cutting and sealing station.

15. The sealing and cutting apparatus of claim 2, including means on said first link first end for adjusting the location of the pivotal mounting of the sealing and cutting unit with respect to the axis of rotation of the resilient roll means whereby the distance between the pivotal connection of the sealing and cutting unit and the axis of rotation of the resilient roll means can be maintained equal to the distance between the axis of rotation of the drive link and its pivotal mounting to the second end of the first link irrespective of the pressure exerted by said biasing means which causes changes of the distance between the sealing and cutting unit pivot and the axis of rotation of the resilient roll means.

16. The apparatus of claim 7, said holding means at each of the accumulator storage bins discharge ends including a gate movable into an opened position at the discharge end of the bin to allow the warp folds to freely be pulled out of the storage bin and said wrap releasing means including means for opening each said gate.

* * * * *